US011688592B2

(12) United States Patent
Kawai et al.

(10) Patent No.: US 11,688,592 B2
(45) Date of Patent: Jun. 27, 2023

(54) PHOTOCATHODE, ELECTRON TUBE, AND METHOD FOR MANUFACTURING PHOTOCATHODE

(71) Applicant: HAMAMATSU PHOTONICS K.K., Hamamatsu (JP)

(72) Inventors: Terunori Kawai, Hamamatsu (JP); Yoshitaka Torii, Hamamatsu (JP); Masami Shibayama, Hamamatsu (JP); Hiroyuki Watanabe, Hamamatsu (JP); Shinichi Yamashita, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 38 days.

(21) Appl. No.: 17/609,519

(22) PCT Filed: May 12, 2020

(86) PCT No.: PCT/JP2020/019001
§ 371 (c)(1),
(2) Date: Nov. 8, 2021

(87) PCT Pub. No.: WO2020/261786
PCT Pub. Date: Dec. 30, 2020

(65) Prior Publication Data

US 2022/0230860 A1 Jul. 21, 2022

(30) Foreign Application Priority Data

Jun. 26, 2019 (JP) ..... JP2019-118249
Jul. 5, 2019 (JP) ..... JP2019-126375

(51) Int. Cl.
*H01J 9/12* (2006.01)
*H01J 43/08* (2006.01)
*H01J 43/18* (2006.01)

(52) U.S. Cl.
CPC ..... *H01J 43/08* (2013.01); *H01J 9/12* (2013.01); *H01J 43/18* (2013.01)

(58) Field of Classification Search
CPC ..... H01J 9/12; H01J 43/18; H01J 43/08
(Continued)

(56) References Cited

U.S. PATENT DOCUMENTS 3,986,065 A 10/1976 Pankove
2010/0096985 A1 4/2010 Watase et al.
(Continued)

FOREIGN PATENT DOCUMENTS

JP 2008-166262 A 7/2008
JP 2010-257962 A 11/2010
(Continued)

OTHER PUBLICATIONS

International Preliminary Report on Patentability dated Jan. 6, 2022 for PCT/JP2020/019001.
(Continued)

*Primary Examiner* — Christopher M Raabe
(74) *Attorney, Agent, or Firm* — Faegre Drinker Biddle & Reath LLP

(57) ABSTRACT

A photocathode including a substrate, a photoelectric conversion layer provided on the substrate and generating photoelectrons in response to incidence of light, and an underlayer provided between the substrate and the photoelectric conversion layer and containing beryllium, in which the underlayer has a first underlayer containing a nitride of beryllium.

19 Claims, 5 Drawing Sheets

(58) Field of Classification Search
USPC ..... 313/543
See application file for complete search history.

(56) References Cited

U.S. PATENT DOCUMENTS

| | | | | |
|---|---|---|---|---|
| 2010/0253218 | A1 | 10/2010 | Yamashita et al. | |
| 2022/0068621 | A1* | 3/2022 | Senko ..... | H01J 49/025 |

FOREIGN PATENT DOCUMENTS

| | | | | |
|---|---|---|---|---|
| JP | 5342769 | B2 | | 11/2013 |
| JP | 6720427 | B1 | | 7/2020 |
| JP | 2021007095 | A | * | 1/2021 |

OTHER PUBLICATIONS

International Preliminary Report on Patentability dated Jan. 6, 2022 for PCT/JP2020/015882.

* cited by examiner (a)

(b)

(a)

(b)

(a)

(b)

PHOTOCATHODE, ELECTRON TUBE, AND METHOD FOR MANUFACTURING PHOTOCATHODE

TECHNICAL FIELD

The present disclosure relates to a photocathode, an electron tube, and a method for manufacturing a photocathode.

BACKGROUND ART

Patent Literature 1 describes a photocathode. This photocathode includes a supporting substrate, a photoelectron emitting layer provided on the supporting substrate, and an underlayer provided between the supporting substrate and the photoelectron emitting layer. The underlayer contains an oxide of a beryllium alloy or a beryllium oxide.

CITATION LIST

Patent Literature

Patent Literature 1: Japanese Patent No. 5342769

SUMMARY OF INVENTION

Technical Problem

In the photocathode described in Patent Literature 1, by providing the underlayer containing a beryllium element between the supporting substrate and the photoelectron emitting layer, an improvement in an effective quantum efficiency is tried to be attained. On the other hand, in the above-described technical field, an improvement in productivity is demanded.

An object of the present disclosure is to provide a photocathode, an electron tube, and a method for manufacturing a photocathode which are capable of improving productivity.

Solution to Problem

The present inventor has conducted intensive studies in order to solve the above-described problem, and thus has attained the following finding. That is, an underlayer containing a nitride of beryllium has a higher productivity (is more efficiently manufactured) than an underlayer of an oxide of a beryllium alloy or a beryllium oxide. The present disclosure is made based on such a finding.

That is, a photocathode according to the present disclosure includes a substrate, a photoelectric conversion layer provided on the substrate and configured to generate photoelectrons in response to incidence of light, and an underlayer provided between the substrate and the photoelectric conversion layer and containing beryllium, in which the underlayer has a first underlayer containing a nitride of beryllium.

In this photocathode, the underlayer containing beryllium is provided between the substrate and the photoelectric conversion layer. Further, the underlayer has the first underlayer containing a nitride of beryllium. Therefore, as shown in the above finding, the underlayer is efficiently manufactured. Thus, according to this photocathode, the productivity can be improved.

In the photocathode according to the present disclosure, the underlayer may have a second underlayer provided between the first underlayer and the photoelectric conversion layer and containing an oxide of beryllium. In this case, the quantum efficiency is improved.

In the photocathode according to the present disclosure, an amount of the oxide of beryllium may be larger than an amount of the nitride of beryllium in the second underlayer. In this case, the quantum efficiency is reliably improved.

In the photocathode according to the present disclosure, the underlayer may be in contact with the substrate. In this case, since the underlayer can formed directly on the substrate, the productivity is further improved.

In the photocathode according to the present disclosure, the photoelectric conversion layer may be in contact with the underlayer. In this case, the quantum efficiency is further improved.

In the photocathode according to the present disclosure, the substrate may be composed of a material that transmits the light. In this case, a transmissive photocathode can be configured.

In the photocathode according to the present disclosure, the amount of the oxide of beryllium may be larger than the amount of the nitride of beryllium in the underlayer. In this case, the quantum efficiency of the photocathode is improved, and the underlayer can function as the underlayer in a wider wavelength range.

In the photocathode according to the present disclosure, in the underlayer, the amount of at least one of the nitride of beryllium and the oxide of beryllium may be unevenly distributed in a thickness direction of the underlayer. At this time, in the underlayer, the amount of the nitride of beryllium may be larger on the substrate side than on the photoelectric conversion layer side, and the amount of the oxide of beryllium may be larger on the photoelectric conversion layer side than on the substrate side.

Alternatively, in the photocathode according to the present disclosure, in the underlayer, the amount of the nitride of beryllium may be substantially uniformly distributed in the thickness direction of the underlayer, and the amount of the oxide of beryllium may be substantially uniformly distributed in the thickness direction of the underlayer. In any of these cases, the quantum efficiency of the photocathode is further improved, and the underlayer can function as the underlayer in a wider wavelength range.

An electron tube according to the present disclosure includes any of the above-described photocathodes and an anode configured to collect electrons. According to this electron tube, the productivity can be improved by the aforementioned reasons.

A method for manufacturing a photocathode according to the present disclosure includes a first step of preparing a substrate, a second step of forming an underlayer containing beryllium on the substrate, and a third step of forming a photoelectric conversion layer configured to generate photoelectrons in response to incidence of light on the underlayer, in which the second step has a forming step of forming an intermediate layer containing a nitride of beryllium on the substrate, and a treatment step of performing an oxidation treatment with respect to the intermediate layer so as to form a first underlayer provided on the substrate and containing a nitride of beryllium and a second underlayer provided on the first underlayer and containing an oxide of beryllium as the underlayer.

In this manufacturing method, after the intermediate layer containing a nitride of beryllium is formed on the substrate, by the oxidation treatment of this intermediate layer, the underlayer including a first underlayer containing a nitride of beryllium and a second underlayer containing an oxide of beryllium is formed. Therefore, as shown in the above finding, the underlayer is efficiently manufactured. Furthermore, the quantum efficiency is improved. Thus, according to this manufacturing method, the productivity of the photocathode with improved quantum efficiency is improved.

In the method for manufacturing a photocathode according to the present disclosure, in the forming step, the intermediate layer may be formed by evaporation or sputtering of beryllium in a nitrogen atmosphere. In this way, by evaporation or sputtering of beryllium in a nitrogen atmosphere, the underlayer (intermediate layer) can be efficiently manufactured.

In the method for manufacturing a photocathode according to the present disclosure, in the forming step, the intermediate layer may be formed by evaporation or sputtering of beryllium in a state of mixing an inert gas different from nitrogen in a nitrogen atmosphere. In this case, the underlayer (intermediate layer) can be more efficiently manufactured.

In the method for manufacturing a photocathode according to the present disclosure, the oxidation treatment may include a heating treatment and/or a discharge treatment. In this way, as the oxidation treatment for the second underlayer, the heating treatment or the discharge treatment is effective.

In the method for manufacturing a photocathode according to the present disclosure, in the treatment step, the oxidation treatment may be performed so that an amount of the oxide of beryllium is larger than an amount of the nitride of beryllium in the second underlayer. In this case, a photocathode with reliably improved quantum efficiency can be manufactured.

In the method for manufacturing a photocathode according to the present disclosure, in the second step, the underlayer may be formed directly on the substrate. In this case, the productivity is further improved.

In the method for manufacturing a photocathode according to the present disclosure, in the third step, the photoelectric conversion layer may be formed directly on the underlayer. In this case, a photocathode with further improved quantum efficiency can be manufactured.

In the method for manufacturing a photocathode according to the present disclosure, the substrate may be composed of a material that transmits the light. In this case, a transmissive photocathode can be manufactured.

Advantageous Effects of Invention

According to the present disclosure, it is possible to provide a photocathode, an electron tube, and a method for manufacturing a photocathode which are capable of improving productivity.

DESCRIPTION OF EMBODIMENTS

Figure 1:
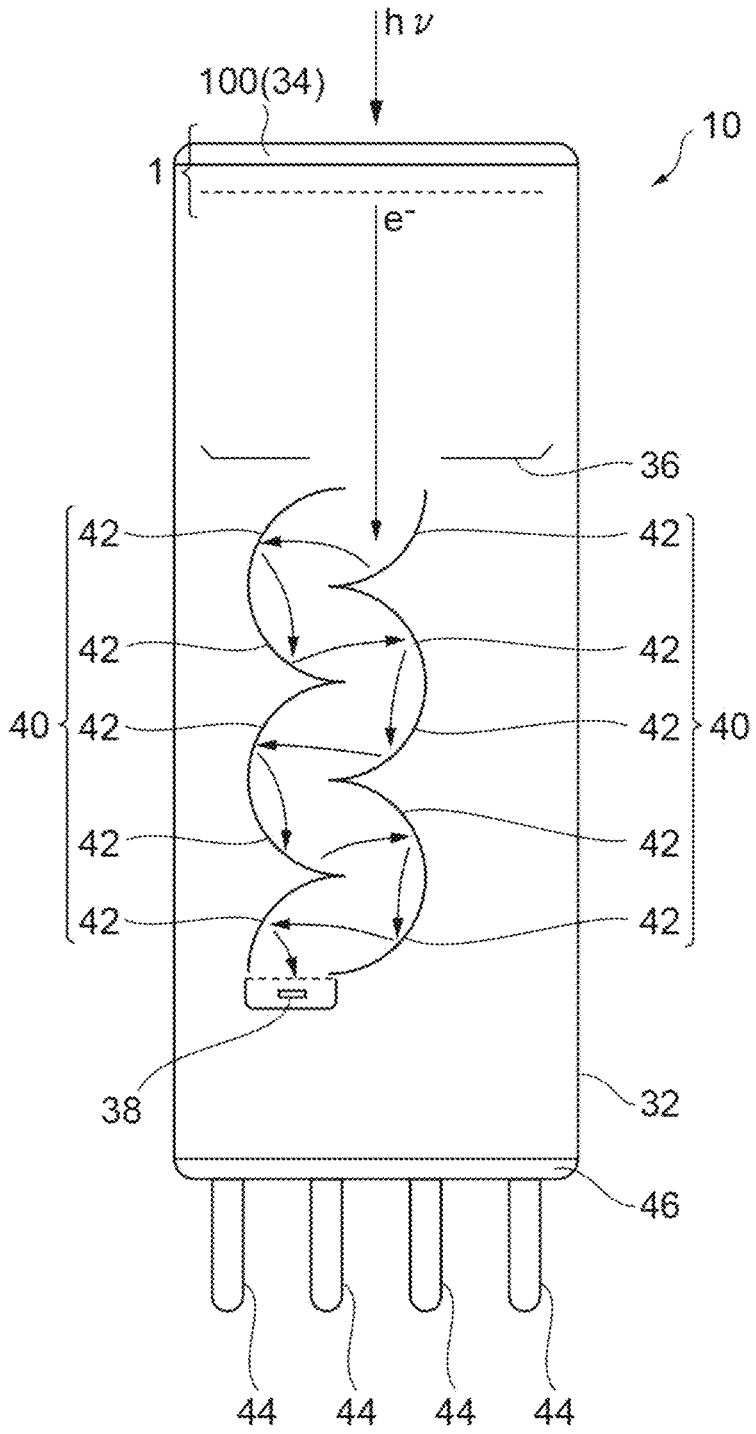
FIG. 1 is a schematic cross-sectional view illustrating an electron tube (photomultiplier) according to the present embodiment.

Hereinafter, an embodiment will be specifically described with reference to the drawings. Note that, in each drawing, the same or equivalent elements are denoted by the same reference numerals, and duplicate description may be omitted.

FIG. 1 is a schematic cross-sectional view illustrating a photomultiplier as an example of an electron tube according to the present embodiment. A photomultiplier (electron tube) 10 illustrated in FIG. 1 includes a photocathode 1, a container 32, a focusing electrode 36, an anode 38, a multiplication unit 40, a stem pin 44, and a stem plate 46. The container 32 has a tubular shape and is configured as a vacuum housing by sealing one end by an input window 34 (herein, a substrate 100 of the photocathode 1) and sealing the other end by the stem plate 46. The focusing electrode 36, the anode 38, and the multiplication unit 40 are disposed in the container 32.

The input window 34 transmits incident light hv. The photocathode 1 emits photoelectrons $e^-$ in response to the incident light hv from the input window 34. The focusing electrode 36 guides the photoelectrons $e^-$ emitted from the photocathode 1 to the multiplication unit 40. The multiplication unit 40 includes a plurality of dynodes 42 and multiplies secondary electrons generated in response to incidence of the photoelectrons e−. The anode 38 collects the secondary electrons generated by the multiplication unit 40. The stem pin 44 is provided to penetrate through the stem plate 46. The corresponding focusing electrode 36, anode 38, and dynodes 42 are electrically connected to the stem pin 44.

Figure 2:
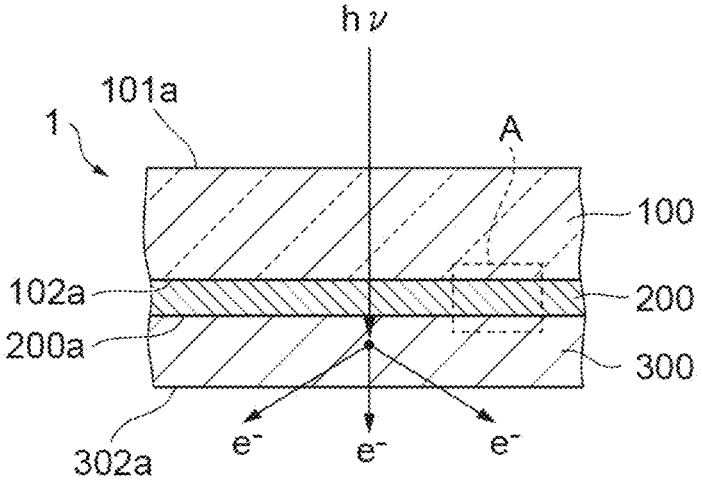
FIG. 2 is a partial cross-sectional view of a photocathode illustrated in FIG. 1.
Figure 2:
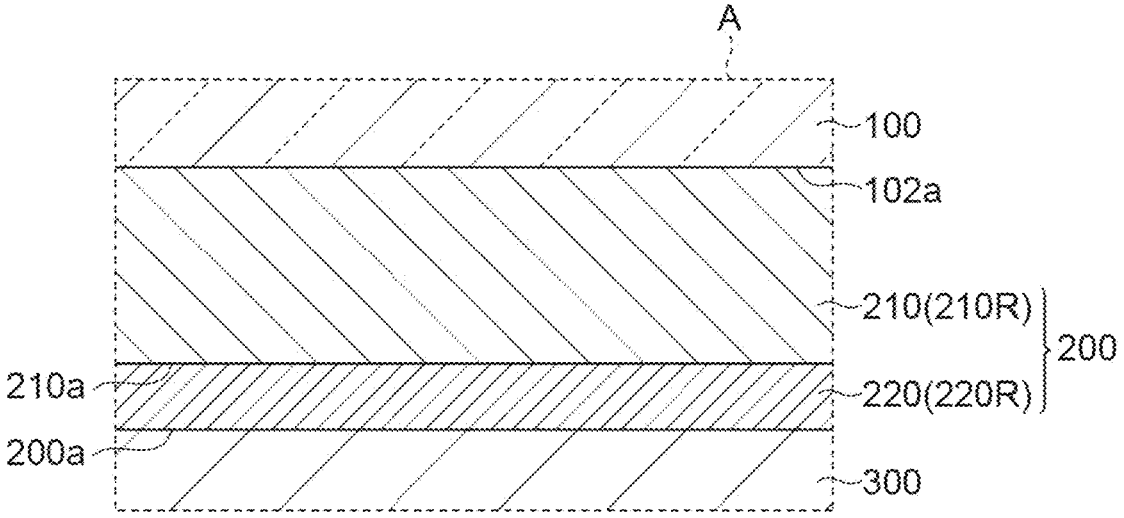

FIG. 2 is a partial cross-sectional view of a photocathode illustrated in FIG. 1. FIG. 2(*b*) is an enlarged view of a region A of FIG. 2(*a*). As illustrated in FIG. 2, the photocathode 1 is configured as a transmissive type. The photocathode 1 has the substrate 100, an underlayer 200, and a photoelectric conversion layer 300. The substrate 100 is composed of a material that transmits the light (incident light hv). The substrate 100 includes a surface 101*a* and a surface (first surface) 102*a* on a side opposite to the surface 101*a*. The surface 101*a* is a surface facing the outside of the container 32 and is an incident surface of the incident light 1*v* herein. The underlayer 200 is provided on the surface 102*a*. The underlayer 200 is in contact with the surface 102*a*. That is, the underlayer 200 is formed directly on the substrate 100 (surface 102*a*).

The underlayer 200 has a surface 200*a* on a side opposite to the surface 102*a*. The photoelectric conversion layer 300 is provided on the surface (second surface) 200*a*. In other words, the photoelectric conversion layer 300 is provided on the substrate 100, and the underlayer 200 is provided between the substrate 100 and the photoelectric conversion layer 300. The photoelectric conversion layer 300 is in contact with the surface 200*a* of the underlayer 200. That is, the photoelectric conversion layer 300 is provided directly on the underlayer 200 (surface 200*a*). In this way, in the photocathode 1, the underlayer 200 and the photoelectric conversion layer 300 are sequentially stacked on the substrate 100. The photoelectric conversion layer 300 receives the incidence of the incident light hv through the substrate 100 and the underlayer 200 and generates the photoelectrons $e^-$ in response to this incident light hv. That is, herein, the photocathode 1 is a transmissive photocathode.

Herein, a first specific example of the configuration of the underlayer 200 will be described. In this first specific example, the underlayer 200 contains a nitride of beryllium (for example, beryllium nitride). More specifically, the underlayer 200 includes a first underlayer 210 containing a nitride of beryllium and a second underlayer 220 containing an oxide of beryllium (for example, beryllium oxide). The first underlayer 210 has a surface (third surface) 210*a* on a side opposite to the surface 102*a* of the substrate 100. The second underlayer 220 is provided on the surface 210*a*. In other words, the second underlayer 220 is provided between the first underlayer 210 and the photoelectric conversion layer 300. Herein, the second underlayer 220 is in contact with the surface 210*a* of the first underlayer 210. Note that, as described below, the surface 210*a* is not limited to a surface having a clear boundary as illustrated in the drawing, and may be an imaginary surface.

The second underlayer 220 has a surface on a side opposite to the surface 102*a* of the substrate 100 and the surface 210*a* of the first underlayer 210. This surface of the second underlayer 220 is the surface 200*a* of the underlayer 200 herein. Furthermore, the first underlayer 210 is in contact with the surface 102*a* of the substrate 100. That is, herein, the underlayer 200 is in contact with the substrate 100 (surface 102*a*) in the first underlayer 210 and is in contact with the photoelectric conversion layer 300 in the second underlayer 220.

The amount of the oxide of beryllium is larger than the amount of the nitride of beryllium in the second underlayer 220. In other words, the amount of the oxide of beryllium is equal to or less than the amount of the nitride of beryllium in the first underlayer 210. The surface 210*a* of the first underlayer 210 may be defined as a boundary between a region where the amount of the oxide of beryllium is larger than the amount of the nitride of beryllium and a region where the amount of the oxide of beryllium is equal to or less than the amount of the nitride of beryllium in a depth direction of the underlayer 200 (a direction intersecting the surface 200*a* of the underlayer 200). In this case, the first underlayer 210 and the second underlayer 220 may be continuously formed, and thus the surface 210*a* may be an imaginary surface.

A ratio of the amount of the oxide of beryllium and the amount of the nitride of beryllium is, for example, a ratio of the numbers of atoms. In this case, a region which includes the surface 200*a* of the underlayer 200 (in the depth direction from the surface 200*a*) and where the ratio of the numbers of atoms of oxygen is larger than the ratio of the numbers of atoms of nitrogen is regarded as the second underlayer 220, and a region on the substrate 100 side in relation to this region may be regarded as the first underlayer 210. Examples of an analysis method of the numbers of atoms include X-ray photoelectron spectroscopy and Auger electron spectroscopy.

The thickness of the entire underlayer 200 is, for example, about 200 Å to 800 Å. The thickness of the first underlayer 210 is, for example, about 200 Å to 700 Å. The thickness of the second underlayer 220 is, for example, about 0 to 100 Å. The ratio of the thickness of the second underlayer 220 to the thickness of the first underlayer 210 is, for example, about 0 to 0.5. The oxygen atom percentage in the second underlayer 220 is, for example, about 30 at % to 100 at %. Note that, in the photocathode 1, the second underlayer 220 may not be provided (that is, "0" may be selected from the above thickness range of the second underlayer 220), and in this case, the thickness of the first underlayer 210 may be consistent with the thickness of the entire underlayer 200. In a case where the second underlayer 220 is provided, the lower limit of the thickness of the second underlayer 220 is, for example, 1 Å.

Subsequently, a second specific example of the configuration of the underlayer 200 will be described. In this second specific example, the underlayer 200 contains a nitride of beryllium (for example, beryllium nitride). Furthermore, the underlayer 200 may contain oxygen. The oxygen may be contained as an oxide of beryllium (for example, beryllium oxide) in the underlayer 200. In a case where the underlayer 200 is considered as a layer including two regions of a first region 210R on the substrate 100 side and a second region 220R on the photoelectric conversion layer 300 side (for example, a layer composed of the first region 210R and the second region 220R), the distribution of the nitride of beryllium and the oxide of beryllium in the first region 210R and the second region 220R may have various forms.

For example, in the underlayer 200, the amount of at least one of the nitride of beryllium and the oxide of beryllium may be unevenly distributed in the thickness direction of the underlayer 200 (that is a direction intersecting the surface 200*a*, the direction toward the photoelectric conversion layer 300 from the substrate 100). More specifically, in the underlayer 200, there may be a difference in distribution of the nitride of beryllium and the oxide of beryllium between the first region 210R and the second region 220R.

For example, in the underlayer 200, the amount of the nitride of beryllium may be larger in the first region 210R than in the second region 220R, and the amount of the oxide of beryllium may be larger in the second region 220R than in the first region 210R. Further, there may be a difference in amount between the nitride of beryllium and the oxide of beryllium to the extent that the first region 210R and the second region 220R can be identified as different layers from each other with the surface 210*a* interposed therebetween. In this case, the first region 210R can be regarded as a nitride layer of beryllium and the second region 220R can be regarded as an oxide layer of beryllium.

On the other hand, in the underlayer 200, the amount of the nitride of beryllium may be substantially uniformly distributed in the thickness direction of the underlayer 200, and the amount of the oxide of beryllium may also be substantially uniformly distributed in the thickness direction of the underlayer 200. In other words, over at least two regions of the first region 210R and the second region 220R, the amount of the nitride of beryllium may be substantially uniformly distributed in the thickness direction thereof, and the amount of the oxide of beryllium may also be substantially uniformly distributed in the thickness direction thereof.

Further, also in any cases, the amount of the oxide of beryllium may be larger than the amount of the nitride of beryllium. Furthermore, also in any cases, the above-described distribution is not necessarily reliably shown over the entire underlayer 200, and basically, it is determined that the above-described distribution is subjectively shown but a region showing a different tendency may also slightly exist.

Furthermore, the above-described first and second specific examples may be arbitrarily combined with each other. For example, the first region 210R and the second region 220R in the second specific example can be replaced by the first underlayer 210 and the second underlayer 220 in the first specific example. In this case, the ranges of the thicknesses of the first underlayer 210 and the second underlayer 220 in the first specific example may be applied to the first region 210R and the second region 220R in the second specific example.

The photoelectric conversion layer 300 is, for example, composed of a compound of antimony (Sb) and an alkali metal. The alkali metal may include, for example, at least any of cesium (Cs), potassium (K), and sodium (Na). The photoelectric conversion layer 300 functions as an active layer of the photocathode 1. The thickness of the photoelectric conversion layer 300 is, for example, about 100 Å to 2500 Å. The thickness of the entire photocathode 1 is, for example, about 300 Å to 3300 Å.

Figure 3:
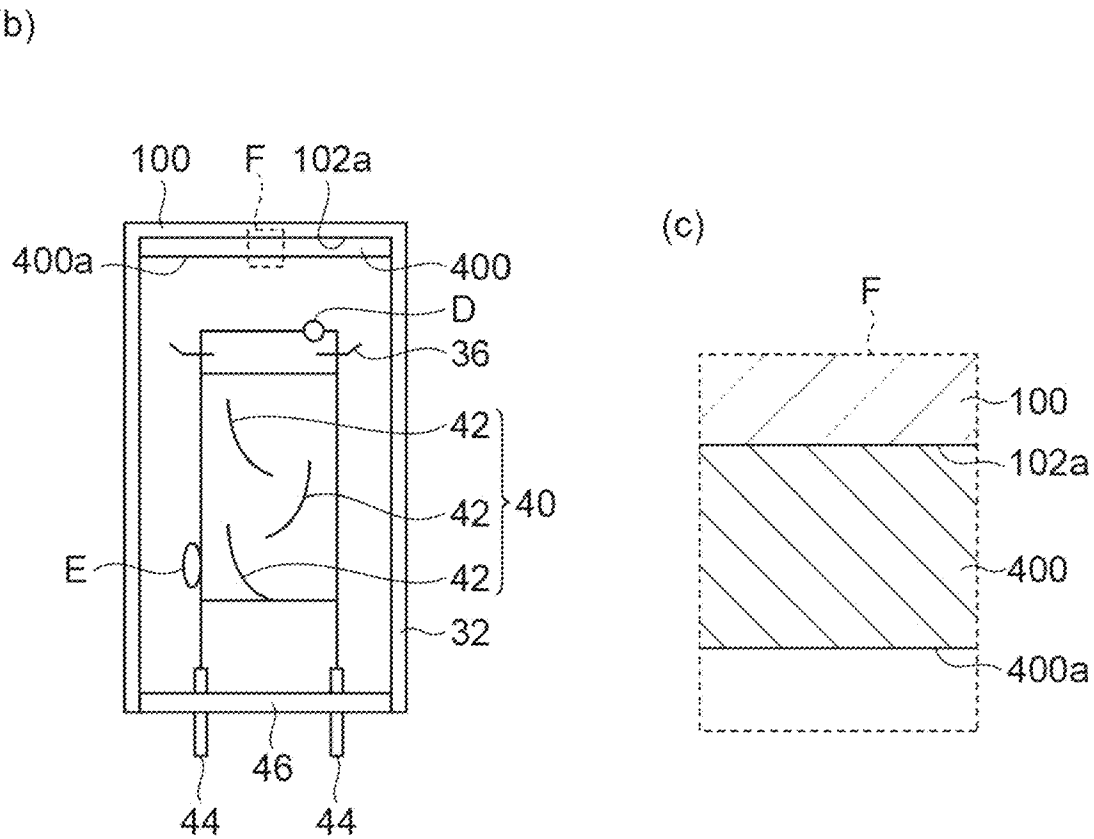
FIG. 3 is a schematic cross-sectional view for describing a method for manufacturing the photocathode illustrated in FIGS. 1 and 2.
Figure 4:
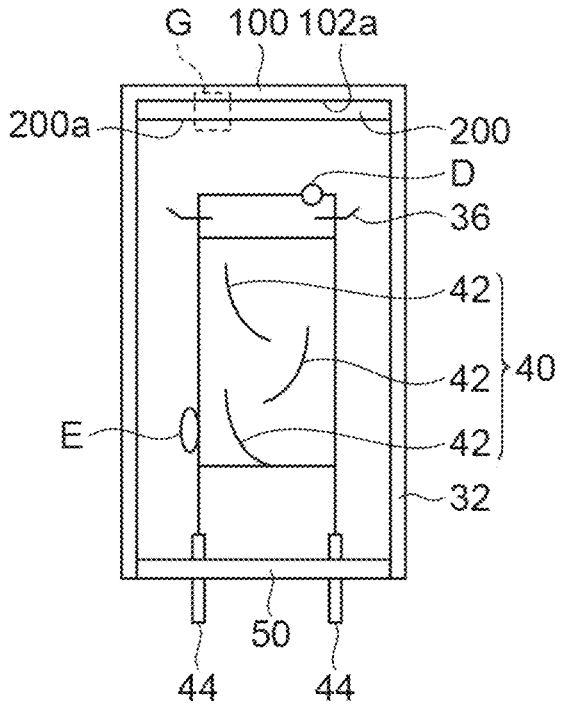
FIG. 4 is a schematic cross-sectional view for describing the method for manufacturing the photocathode illustrated in FIGS. 1 and 2.
Figure 4:
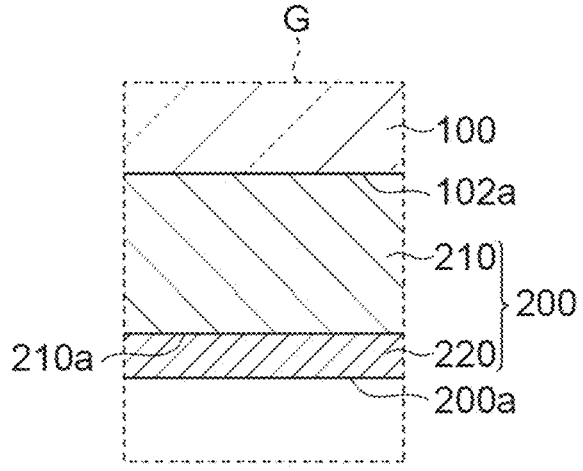
Figure 5:
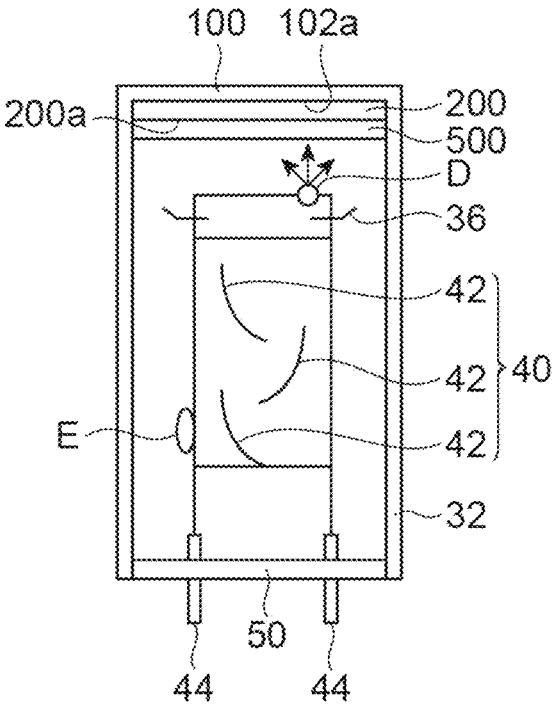
FIG. 5 is a schematic cross-sectional view for describing the method for manufacturing the photocathode illustrated in FIGS. 1 and 2.
Figure 5:
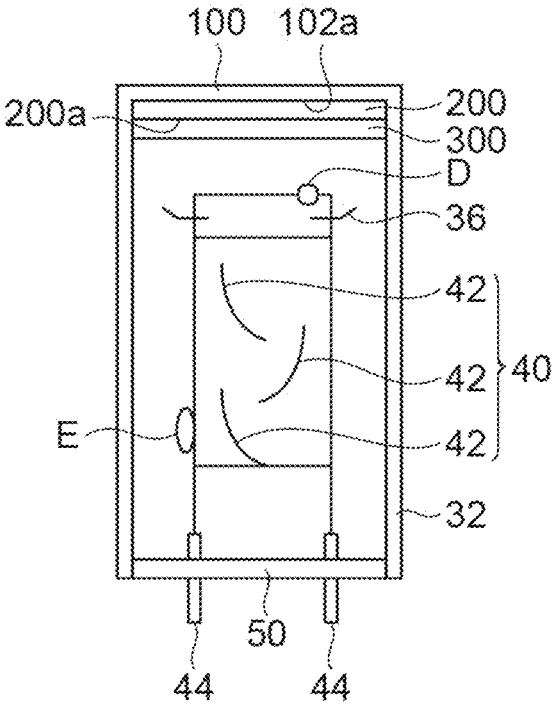

Subsequently, a method for manufacturing the photocathode 1 will be described. FIGS. 3 to 5 are schematic cross-sectional views for describing a method for manufacturing the photocathode illustrated in FIGS. 1 and 2. FIG. 3(*c*) is an enlarged view of a region F of FIG. 3(*b*). FIG. 4(*b*) is an enlarged view of a region G of FIG. 4(*a*). In this manufacturing method, first, as illustrated in FIG. 3(*a*), the substrate 100 is prepared (first step). Herein, the container 32 configured by sealing one end by the substrate 100 is prepared. Subsequently, the underlayer 200 containing beryllium is formed on the substrate 100 (surface 102*a*) (second step). The second step will be specifically described.

In the second step, first, an intermediate layer 400 containing a nitride of beryllium (for example, beryllium nitride) is formed on the substrate 100 (surface 102*a*) (forming step). More specifically, first, the container 32 (substrate 100) subjected to a washing treatment is disposed in a chamber B. Furthermore, a beryllium source C is disposed in the chamber B to face the substrate 100 (surface 102*a*). Then, while the atmosphere inside the chamber B is replaced by a nitrogen atmosphere, the intermediate layer 400 is formed directly on the substrate 100 (surface 102*a*) by evaporation or sputtering of beryllium in that nitrogen atmosphere (see FIGS. 3(*b*) and 3(*c*)). The atmosphere inside the chamber B at this time may be composed of only nitrogen or may be mixed with an inert gas different from nitrogen. As the inert gas, for example, argon, helium, neon, krypton, xenon, hydrogen, and the like are mentioned.

As an evaporation method, resistive heating vapor deposition, chemical vapor deposition, and the like can be used. As the sputtering, DC magnetron reactive sputtering, RF magnetron sputtering (non-reactive), RF magnetron reactive sputtering, or the like can be used.

In the subsequent step, as illustrated in FIG. 3(*b*), the other end of the container 32 is sealed by the stem plate 46 attached with the focusing electrode 36, the anode 38, and the multiplication unit 40. An evaporation source D is disposed in the focusing electrode 36. Furthermore, in the stem plate 46, an alkali metal source E is disposed through the stem pin 44. In this state, as illustrated in FIG. 4, the underlayer 200 is formed from the intermediate layer 400 by the oxidation treatment of the intermediate layer 400 (treatment step). More specifically, in the treatment step, the oxidation treatment is performed with respect to the intermediate layer 400 from a side in the intermediate layer 400 opposite to the substrate 100. Thereby, a film-shaped region, which includes a surface 400*a* in the intermediate layer 400 on a side opposite to the substrate 100 and contains a nitride of beryllium, is substituted with a region containing an oxide of beryllium. As a result, the first underlayer 210 and the second underlayer 220 are formed, and the underlayer 200 is obtained.

That is, in the treatment step, the oxidation treatment is performed with respect to the intermediate layer 400 from a side opposite to the substrate 100 (surface 102*a*) so that the first underlayer 210 provided on the substrate 100 (surface 102*a*) and containing a nitride of beryllium and the second underlayer 220 provided on the surface 210*a* in the first underlayer 210 on a side opposite to the substrate 100 (surface 102*a*) and containing an oxide of beryllium are formed as the underlayer 200. The method of the oxidation treatment is, for example, a heating treatment and/or a discharge treatment.

In the case of oxidation by discharge, DC discharge oxidation, AC discharge oxidation (for example, RF discharge oxidation), or the like can be used. In the case of utilizing glow discharge as the method of the oxidation treatment, after oxygen is appropriately enclosed in the container 32 set in a vacuum state, a voltage is applied between the focusing electrode 36 and the container 32 (substrate 100), and the region containing a nitride of beryllium is substituted with the region containing an oxide of beryllium from the surface 400*a* side of the intermediate layer 400. The pressure (gas pressure) in the container 32 at this time is, for example, about 0.01 Pa to 1000 Pa.

Note that, in the forming step, the underlayer 200 containing a nitride of beryllium and an oxide of beryllium is formed by using an atmosphere containing nitrogen and oxygen, and thus this oxidation treatment (treatment step) may be omitted. Alternatively, the amount of the oxide of beryllium in the underlayer 200 may be further increased by further executing this oxidation treatment (treatment step). As the oxidation treatment method, in addition to oxidation by discharge or oxidation by heat as mentioned above, oxidation by light, oxidation by an oxidative atmosphere (such as ozone or water-vapor atmosphere) or an oxidant (such as an oxidizing solution), a combination thereof, and the like can be used. Further, by changing conditions of the oxidation treatment method, the underlayer 200 with the distribution as mentioned above can be obtained.

In the subsequent step, as illustrated in FIG. 5, the photoelectric conversion layer 300 is formed on the surface 200*a* of the underlayer 200 on a side opposite to the substrate 100 (third step). More specifically, in the third step, first, as illustrated in FIG. 5(*a*), an intermediate layer 500 is formed on the surface 200*a* by evaporation of antimony using the evaporation source D. Subsequently, as illustrated in FIG. 5(*b*), the intermediate layer 500 is activated by supplying vapor of alkali metal from the alkali metal source E to the intermediate layer 500. Thereby, the photoelectric conversion layer 300 composed of a compound of antimony and an alkali metal is formed from the intermediate layer 500.

As described above, in the photocathode 1 according to the present embodiment, the underlayer 200 containing beryllium is provided between the substrate 100 and the photoelectric conversion layer 300. Further, the underlayer 200 has the first underlayer 210 containing a nitride of beryllium. According to the finding of the present inventor, the film formation rate of a film containing a nitride of beryllium becomes higher than the film formation rate of a film containing an oxide of beryllium, for example, by sputtering in a nitrogen atmosphere, or the like. That is, the underlayer 200 is efficiently manufactured. Thus, according to this photocathode 1, the productivity is improved. Note that, according to the finding of the present inventor, in the case of using the underlayer 200 containing a nitride of beryllium, sufficient sensitivity (quantum efficiency) can also be secured.

Furthermore, in the photocathode 1 according to the present embodiment, the underlayer 200 has the second underlayer 220 provided between the first underlayer 210 and the photoelectric conversion layer and containing an oxide of beryllium. Therefore, the quantum efficiency is improved.

Furthermore, in the photocathode 1 according to the present embodiment, the amount of the oxide of beryllium is larger than the amount of the nitride of beryllium in the second underlayer 220. Therefore, the quantum efficiency is reliably improved. Furthermore, in the photocathode 1 according to the present embodiment, the underlayer 200 is in contact with the substrate 100. Therefore, since the underlayer 200 can be formed directly on the substrate 100, the productivity is further improved.

Furthermore, in the photocathode 1 according to the present embodiment, the photoelectric conversion layer 300 is in contact with the underlayer 200. Therefore, the quantum efficiency is further improved. More specifically, when the underlayer 200 containing beryllium is provided in a state of being in contact with the photoelectric conversion layer 300, the diffusion of an alkali metal (for example, potassium or cesium) contained in the photoelectric conversion layer 300 is effectively suppressed in the manufacturing process, and as a result, it is considered to realize a highly effective quantum efficiency. Moreover, the underlayer 200 functions so as to reverse a direction of, out of photoelectrons generated in the photoelectric conversion layer 300, photoelectrons traveling toward the substrate 100 side to the photoelectric conversion layer 300 side, and as a result, it is considered to improve the quantum efficiency of the photocathode 1 as a whole.

Note that, the photocathode 1 includes the underlayer 200 containing beryllium. In this way, by using the underlayer 200 containing beryllium, an effective quantum efficiency is further improved and the sensitivity is improved.

Furthermore, in the photocathode 1, the underlayer 200 may contain an oxide of beryllium. In this case, the quantum efficiency of the photocathode 1 is improved, and the underlayer can function as the underlayer 200 in a wider wavelength range.

Furthermore, in the photocathode 1, the amount of the oxide of beryllium may be larger than the amount of the nitride of beryllium in the underlayer 200. In this case, the quantum efficiency of the photocathode 1 is further improved, and the underlayer can function as the underlayer in a wider wavelength range.

Furthermore, in the photocathode 1, in the underlayer 200, the amount of at least one of the nitride of beryllium and the oxide of beryllium may be unevenly distributed in the thickness direction of the underlayer 200, the amount of the nitride of beryllium may be substantially uniformly distributed in the thickness direction of the underlayer 200, and the amount of the oxide of beryllium may be substantially uniformly distributed in the thickness direction of the underlayer 200. In the case of uneven distribution, when the underlayer 200 is regarded as a layer including two regions of the first region 210R on the substrate 100 side and the second region 220R on the photoelectric conversion layer 300 side, in the underlayer 200, the amount of the nitride of beryllium may be larger on the first region 210R side (substrate 100 side) than on the second region 220R side (photoelectric conversion layer 300 side), and the amount of the oxide of beryllium may be larger on the second region 220R side (photoelectric conversion layer 300 side) than on the first region 210R side (substrate 100 side). Further, the first region 210R and the second region 220R may be the first underlayer and the second underlayer stacked alternately, and the second underlayer may be positioned on the photoelectric conversion layer 300 side in relation to the first underlayer and may contain an oxide of beryllium. Also in any cases, the quantum efficiency of the photocathode 1 is further improved, and the underlayer can function as the underlayer in a wider wavelength range.

Herein, in the method for manufacturing the photocathode 1 according to the present embodiment, after the intermediate layer 400 containing a nitride of beryllium is formed on the substrate 100, by the oxidation treatment of this intermediate layer 400, the underlayer 200 including the first underlayer 210 containing a nitride of beryllium and the second underlayer 220 containing an oxide of beryllium is formed. Therefore, as shown in the above finding, the underlayer 200 is efficiently manufactured. Furthermore, the quantum efficiency is improved. Thus, according to this manufacturing method, the productivity of the photocathode 1 with improved quantum efficiency is improved.

Furthermore, in the method for manufacturing the photocathode 1 according to the present embodiment, in the forming step, the intermediate layer 400 is formed by evaporation or sputtering of beryllium in a nitrogen atmosphere. In this way, by evaporation or sputtering of beryllium in a nitrogen atmosphere, the underlayer 200 (intermediate layer 400) can be efficiently manufactured.

Furthermore, in the method for manufacturing the photocathode 1 according to the present embodiment, in the forming step, the intermediate layer 400 is formed by evaporation or sputtering of beryllium in a state of mixing an inert gas different from nitrogen in a nitrogen atmosphere. Therefore, the underlayer 200 (intermediate layer 400) can be more efficiently manufactured.

Furthermore, in the method for manufacturing the photocathode 1 according to the present embodiment, as the oxidation treatment for forming the second underlayer 220, a heating treatment or a discharge treatment is effective. According to the finding of the present inventor, by utilizing oxidation by glow discharge as the oxidation treatment, an improvement in the sensitivity (quantum efficiency) can be attained as compared to oxidation by heat.

Furthermore, in the method for manufacturing the photocathode 1 according to the present embodiment, in the treatment step, the oxidation treatment is performed so that the amount of the oxide of beryllium is larger than the amount of the nitride of beryllium in the second underlayer 220. Thereby, a photocathode with reliably improved quantum efficiency can be manufactured.

Furthermore, in the method for manufacturing the photocathode 1 according to the present embodiment, in the second step, the underlayer 200 is formed directly on the substrate 100. Therefore, the productivity is further improved. Moreover, in the method for manufacturing the photocathode 1 according to the present embodiment, in the third step, the photoelectric conversion layer 300 is formed directly on the underlayer 200. Therefore, as shown in the above finding, the photocathode 1 with further improved quantum efficiency can be manufactured.

The above embodiment is to describe an embodiment of the present disclosure. Thus, the present disclosure is not limited to the above-described embodiment, and various modifications may be made. For example, in the above-described embodiment, the photocathode 1 has been described as a transmissive type, but the photocathode 1 can also be configured as a reflective type. Furthermore, another layer may be interposed between the substrate 100 (surface 102*a*) and the underlayer 200 and/or between the underlayer 200 (surface 200*a*) and the photoelectric conversion layer 300.

Furthermore, in the above-described embodiment, the first underlayer 210 and the second underlayer 220 were formed by the oxidation treatment of the intermediate layer 400 containing a nitride of beryllium. On the other hand, the first underlayer 210 and the second underlayer 220 may be formed by forming a film containing a nitride of beryllium (a layer that becomes the first underlayer 210) and then newly forming a film containing an oxide of beryllium (a layer that becomes the second underlayer) with respect to that film. In this case, the surface 210*a* between the first underlayer 210 and the second underlayer 220 may be an actually existing surface.

INDUSTRIAL APPLICABILITY

A photocathode, an electron tube, and a method for manufacturing a photocathode which are capable of improving productivity are provided.

REFERENCE SIGNS LIST

1: photocathode, 10: photomultiplier (electron tube), 100: substrate, 200: underlayer, 210: first underlayer, 220: second underlayer, 300: photoelectric conversion layer, 400, 500: intermediate layer.

The invention claimed is:

1. A photocathode comprising:

a substrate;

a photoelectric conversion layer provided on the substrate and configured to generate photoelectrons in response to incidence of light; and an underlayer provided between the substrate and the photoelectric conversion layer and containing beryllium, wherein the underlayer has a first underlayer containing a nitride of beryllium.

2. The photocathode according to claim 1, wherein the underlayer has a second underlayer provided between the first underlayer and the photoelectric conversion layer and containing an oxide of beryllium.

3. The photocathode according to claim 2, wherein an amount of the oxide of beryllium is larger than an amount of the nitride of beryllium in the second underlayer.

4. The photocathode according to claim 1, wherein the underlayer is in contact with the substrate.

5. The photocathode according to claim 1, wherein the photoelectric conversion layer is in contact with the underlayer.

6. The photocathode according to claim 1, wherein the substrate is composed of a material that transmits the light.

7. The photocathode according to claim 1, wherein the amount of the oxide of beryllium is larger than the amount of the nitride of beryllium in the underlayer.

8. The photocathode according to claim 1, wherein in the underlayer, the amount of at least one of the nitride of beryllium and the oxide of beryllium is unevenly distributed in a thickness direction of the underlayer.

9. The photocathode according to claim 8, wherein in the underlayer, the amount of the nitride of beryllium is larger on the substrate side than on the photoelectric conversion layer side, and the amount of the oxide of beryllium is larger on the photoelectric conversion layer side than on the substrate side.

10. The photocathode according to claim 1, wherein in the underlayer, the amount of the nitride of beryllium is substantially uniformly distributed in the thickness direction of the underlayer, and the amount of the oxide of beryllium is substantially uniformly distributed in the thickness direction of the underlayer.

11. An electron tube comprising:

the photocathode according to claim 1; and an anode configured to collect electrons.

12. A method for manufacturing a photocathode, the method comprising:

a first step of preparing a substrate;

a second step of forming an underlayer containing beryllium on the substrate; and a third step of forming a photoelectric conversion layer configured to generate photoelectrons in response to incidence of light on the underlayer, wherein the second step has a forming step of forming an intermediate layer containing a nitride of beryllium on the substrate, and a treatment step of performing an oxidation treatment with respect to the intermediate layer so as to form a first underlayer provided on the substrate and containing a nitride of beryllium and a second underlayer provided on the first underlayer and containing an oxide of beryllium as the underlayer.

13. The method for manufacturing a photocathode according to claim 12, wherein in the forming step, the intermediate layer is formed by evaporation or sputtering of beryllium in a nitrogen atmosphere.

14. The method for manufacturing a photocathode according to claim 13, wherein in the forming step, the intermediate layer is formed by evaporation or sputtering of beryllium in a state of mixing an inert gas different from nitrogen in a nitrogen atmosphere.

15. The method for manufacturing a photocathode according to claim 12, wherein the oxidation treatment includes a heating treatment and/or a discharge treatment.

16. The method for manufacturing a photocathode according to claim 12, wherein in the treatment step, the oxidation treatment is performed so that an amount of the oxide of beryllium is larger than an amount of the nitride of beryllium in the second underlayer.

17. The method for manufacturing a photocathode according to claim 12, wherein in the second step, the underlayer is formed directly on the substrate.

18. The method for manufacturing a photocathode according to claim 12, wherein in the third step, the photoelectric conversion layer is formed directly on the underlayer.

19. The method for manufacturing a photocathode according to claim 12, wherein the substrate is composed of a material that transmits the light.

* * * * *